US010983460B2

(12) United States Patent
Berger et al.

(10) Patent No.: US 10,983,460 B2
(45) Date of Patent: Apr. 20, 2021

(54) CURVED INK GUTTER SLOPED TOWARDS AN INK OUTLET IN A WALL

(71) Applicant: HP Indigo B.V., Amstelveen (NL)

(72) Inventors: Shachar Berger, Ness Ziona (IL); Sagie Shanun, Ness Ziona (IL); Ziv Yosef, Ness Ziona (IL); Shay Rahamim, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/606,215

(22) PCT Filed: Oct. 31, 2017

(86) PCT No.: PCT/EP2017/077924
§ 371 (c)(1),
(2) Date: Oct. 17, 2019

(87) PCT Pub. No.: WO2019/086109
PCT Pub. Date: May 9, 2019

(65) Prior Publication Data

US 2020/0257222 A1 Aug. 13, 2020

(51) Int. Cl.
*G03G 15/11* (2006.01)
*G03G 15/10* (2006.01)
(Continued)

(52) U.S. Cl.
CPC ..... *G03G 15/11* (2013.01); *G03G 15/104* (2013.01); *G03G 21/10* (2013.01); *G03G 21/105* (2013.01);
(Continued)

(58) Field of Classification Search
CPC .. G03G 15/0121; G03G 15/10; G03G 15/104; G03G 15/11; G03G 21/10; G03G 21/105; G03G 21/12; G03G 2215/0658
See application file for complete search history.

(56) References Cited

U.S. PATENT DOCUMENTS 6,125,254 A 9/2000 Chang et al.
7,356,287 B2 4/2008 Guzman et al.
(Continued)

FOREIGN PATENT DOCUMENTS

JP H05273801 A 10/1993
KR 20010084225 A 9/2001

*Primary Examiner* — Joseph S Wong
(74) *Attorney, Agent, or Firm* — HP Inc. Patent Department

(57) ABSTRACT

In one aspect an apparatus for use in an electrographic printer is described. The apparatus includes a housing having a base, a first wall, and a second wall, wherein the housing defines a cavity. The apparatus also includes a developer roller and an ink developer electrode for developing ink to the developer roller. The apparatus also includes an ink outlet, and a gutter for directing ink in the cavity towards the ink outlet, the gutter being disposed between the first wall and second wall, and between the developer roller and base. The gutter has a floor, a first side, and a second side, each extending along a length of the gutter. The floor slopes towards the ink outlet to direct ink towards the ink outlet, and the floor and sides of the gutter form a curve transverse to the length of the gutter to direct ink towards the floor.

15 Claims, 7 Drawing Sheets

(51) Int. Cl.
*G03G 21/10* (2006.01)
*G03G 21/12* (2006.01)

(52) U.S. Cl.
CPC ..... *G03G 21/12* (2013.01); *G03G 2215/0658* (2013.01)

(56) References Cited

U.S. PATENT DOCUMENTS

| | | | | |
|---|---|---|---|---|
| 9,291,948 | B2 | 3/2016 | Tanner et al. | |
| 2005/0053398 | A1* | 3/2005 | Kim ..... | G03G 15/11 399/237 |
| 2008/0141882 | A1 | 6/2008 | Sabo et al. | |

* cited by examiner

CURVED INK GUTTER SLOPED TOWARDS AN INK OUTLET IN A WALL

BACKGROUND

An electrographic printing system may use digitally controlled lasers to create a latent image in the charged surface of a photo imaging plate (PIP). The lasers may be controlled according to digital instructions from a digital image file. Digital instructions may include one or more of the following parameters: image color, image spacing, image intensity, order of the color layers, etc. A printing substance may then be applied to the partially-charged surface of the PIP, recreating the desired image. The image may then be transferred from the PIP to a transfer blanket on a transfer cylinder and from the transfer blanket to the desired substrate, which may be placed into contact with the transfer blanket by an impression cylinder. The printing substance may be applied to the surface of the PIP from one or more printing substance application assemblies, such as developer units.

BRIEF DESCRIPTION OF THE DRAWINGS

Various features of the present disclosure will be apparent from the detailed description which follows, taken in conjunction with the accompanying drawings, which together illustrate features of the present disclosure, and wherein.

DETAILED DESCRIPTION

Figure 1B:
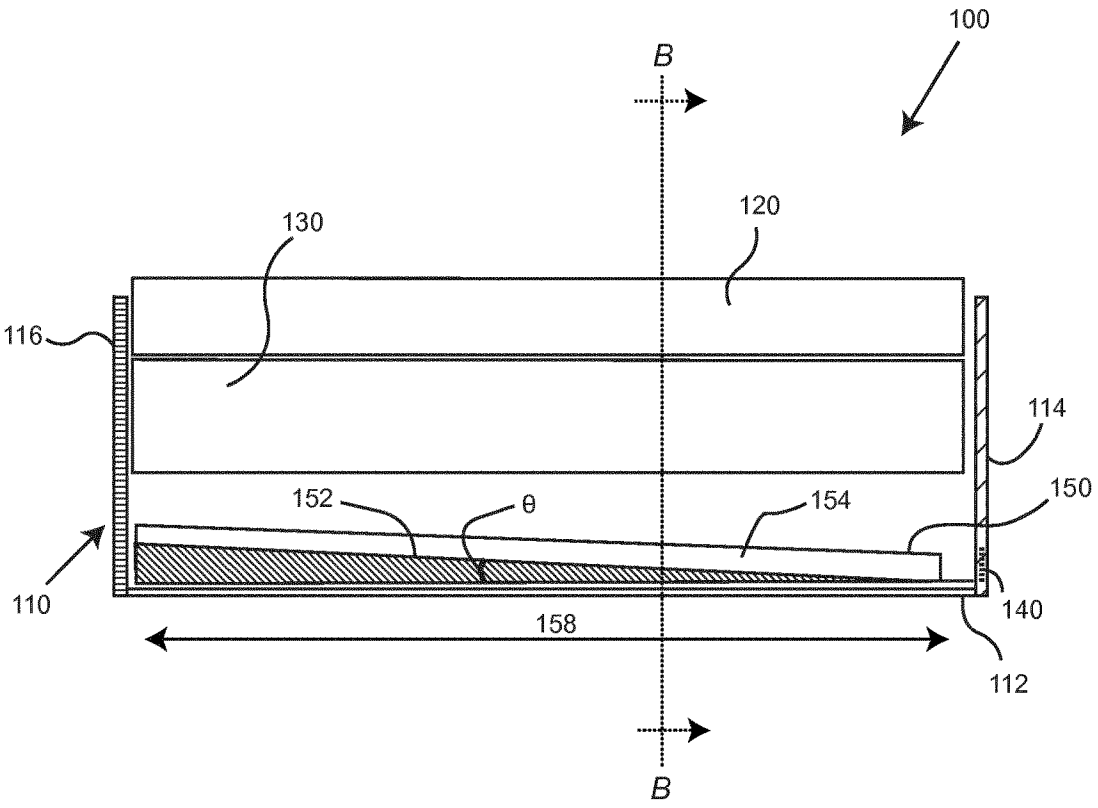
FIGS. 1B and 1C are schematic diagrams showing sectional views of the developer unit of FIG. 1A.

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Electrographic printing (also referred to as electrophotographic printing) refers to a process of printing in which a printing substance (e.g., a liquid or dry electrographic ink or toner) can be applied onto a surface having a pattern of electrostatic charge. The printing substance conforms to the electrostatic charge to form an image in the printing substance that corresponds to the electrostatic charge pattern.

In some electrographic printers, a printing substance may be transferred onto a photo-imaging cylinder by one or more developer units. In some examples, the printing substance may be a liquid printing substance, such as liquid ink. In examples wherein the printing substance is a liquid ink, the developer unit may be referred to as an ink developer unit. In other examples the printing substance may be other than liquid ink, such as toner. In some examples, there may be one developer unit for each printing substance and/or printing substance color. During printing, the appropriate developer unit can be engaged with the photo-imaging cylinder. The engaged developer unit may present a uniform film of printing substance to the photo-imaging cylinder.

The printing substance may be liquid ink, such as electroink. In electroink, ink particles are suspended in a liquid carrier. In one example, ink particles can be incorporated into a resin that is suspended in a carrier liquid. Appropriate carrier liquids might include branched chain alkanes, such as isoparaffin. The ink particles may be electrically charged such that they can be controlled when subjected to an electric field. The printing substance may comprise electrically charged pigment particles that are attracted to oppositely charged electrical fields on the image areas of the photo-imaging cylinder. The printing substance may be repelled from the charged, non-image areas. The result may be that the photo-imaging cylinder is provided with the image, in the form of an appropriate pattern of the printing substance, on its surface. In other examples, such as those for black and white (monochromatic) printing, one or more developer units may alternatively be provided.

Particles of a printing substance may be referred to generally as ink particles (including particles in a liquid ink). Ink particles in the printer may be electrically charged such that they can be controlled when subjected to an electric field. The ink particles may be negatively charged and therefore repelled from the negatively charged portions of the photo imaging cylinder, and attracted to the discharged portions of the photo imaging cylinder.

In use, printing substance may be supplied to a developer unit to be developed to a developer roller. Printing substance which is not developed to the developer roller may accumulate within the housing of the developer unit. Accumulation of printing substance in the housing of the developer unit may result in leakages and ink-on-consumer events.

There are therefore provided herein examples of apparatuses such as developer units which are configured to direct printing substance out of the developer unit. The level of accumulation of printing substance in the housing of these apparatuses may be low. Certain examples will now be described in more detail with reference to the Figures.

Figure 1A:
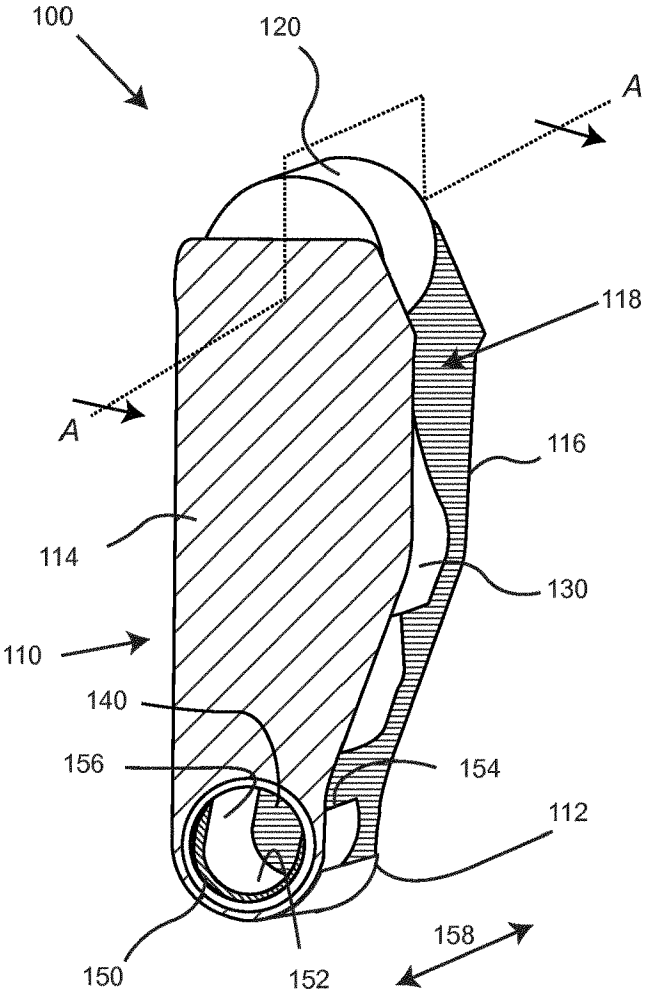
FIG. 1A is a schematic diagram showing a developer unit according to an example of the present disclosure.
Figure 1C:
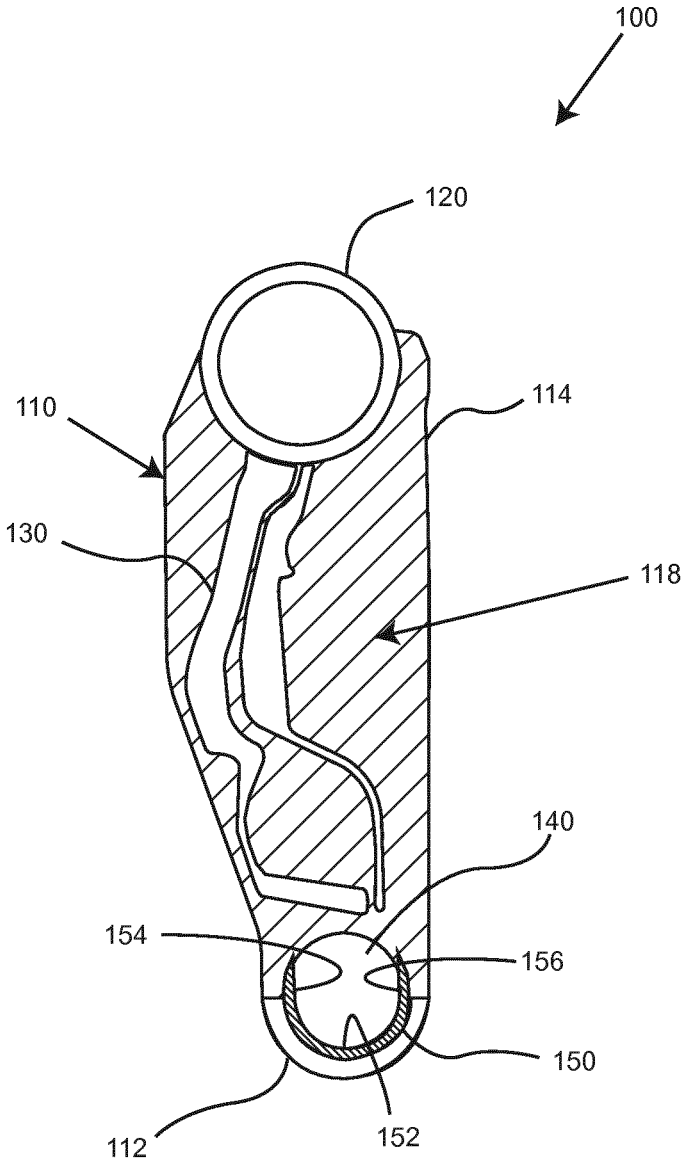

FIGS. 1A, 1B and 1C show an apparatus 100 according to an example of the present disclosure. FIG. 1A is a perspective view of apparatus 100. FIG. 1B is a longitudinal sectional view of apparatus 100, viewed in plane A-A of FIG. 1A. FIG. 1C is a transverse sectional view of apparatus 100, viewed in plane B-B of FIG. 1B.

The apparatus 100 is an apparatus for disposing printing substance onto a photoconductor. That is, apparatus 100 is a developer unit. The apparatus 100 may be a developer unit for disposing liquid printing substance onto a photoconductor. For example, the apparatus 100 may be an ink developer unit, for disposing ink onto a photoconductor. The apparatus includes a housing 110 which comprises a base 112, a first wall 114, and a second wall 116. The housing 110 defines a cavity 118. The housing 110 may be provided to protect the components of the apparatus 100, and/or to prevent the release of printing substance into unwanted portions of the electrographic printer system in use. In some examples, the housing 110 may be formed of plastics. In other examples, the housing 110 may be formed of metal, such as aluminum.

Cavity 118 does not necessarily refer to an enclosed chamber. Rather, cavity 118 may be a volume within which components of the apparatus 100 may be arranged. It follows that housing 110 does not necessarily completely enclose a volume, and may comprise ports and openings to allow for material to enter or exit the cavity 118.

Arranged in the cavity is a developer roller 120 and a developer electrode 130. The electrode 130 is arranged to develop printing substance such as ink onto developer roller 120. The roller 120 and electrode 130 may be arranged so that there is a gap between roller 120 and electrode 130. Developing printing substance to developer roller 120 may include generating an electrical potential between developer electrode 130 and developer roller 120, and thereby supplying at least some printing substance to the roller to provide a layer of printing substance. For example, supplying ink comprising charged pigment particles to the electrode 130 may impel said particles comprised in the ink to be deposited on the oppositely charged developer roller 120. The particles deposited on developer roller 120 may form a film of ink particles to be transferred to a transfer element in the electrographic printer. Ink is not deposited on developer roller 120 by contacting the roller 120 with a reservoir of ink.

The developer roller 120 may be provided as a cylinder rotatable around an axis arranged within the cavity 118. The developer roller 120 can be electrostatically charged to provide an electric potential between the electrode 130 and the developer roller 120. The developer roller may have a polyurethane coating, for example.

In use, the electrode 130 may have may have an electric potential of from approximately 500V to 1500V, or from approximately 750 to 1250V, or of approximately 1000V.

The apparatus 100 also comprises an ink outlet 140. The ink outlet 140 is arranged so that printing substance (such as ink) may pass from the cavity 118 to an area external to the apparatus 100. Ink outlet 140 may comprise an aperture, for example. In some examples, ink outlet 140 comprises an aperture and a valve arranged within the aperture for controlling passage of printing substance through ink outlet 140. For example, the ink outlet may comprise a valve arranged to restrict flow of print substance into the cavity 118 from an area external to the apparatus 100, without substantially restricting flow of printing substance from the cavity 118 to an area external to the apparatus 100.

The apparatus 100 further comprises a gutter 150 for directing ink in cavity 118 towards ink outlet 140. Gutter 150 is disposed between first wall 114 and second wall 116, and between developer roller 120 and base 112. Gutter 150 may be disposed between electrode 130 and base 112.

Gutter 150 has a floor 152, a first side 154, and a second side 156. Gutter 150 has a length 158. Floor 152, first side 154 and second side 156 extend along length 158 in a direction from second wall 116 to first wall 114.

Floor 152 slopes toward ink outlet 140, as shown in FIG. 1B. The slope of floor 152 may direct, or "bias", ink towards ink outlet 140. In use, printing substance such as ink may be present in cavity 118. Apparatus 100 may be arranged so that ink present in cavity 118 is disposed on or in gutter 150, and the slope of floor 152 may bias the ink disposed on or in gutter 150 toward ink outlet 140.

The slope of floor 152 may be defined as angle θ from base 112 of apparatus 100 to floor 152 of gutter 150. In some examples, θ may be an angle of from 0.5° to 5°, or from 1 to 3°, or from 1.5 to 2.5°, or around 2°.

In some examples, floor 152 may abut first wall 114. In some examples, gutter 150 may abut first wall 114. In some examples, gutter 150 may abut second wall 116.

Floor 152 and sides 154 and 156 of gutter 150 form a curve transverse to length 158, as shown in FIG. 1C. The curved shape of the gutter may direct ink towards floor 152. Floor 152 corresponds to the lowest point of the curve. For example, ink incident on side walls 154 and 156 will be biased towards floor 152. The curved shape may also direct ink toward ink outlet 140. The curve formed by floor 152 and sides has a width and depth, which may be referred to as the width and depth of gutter 150.

In some examples, a material that constitutes all or part of gutter 150 may be plastics. For example, the material that constitutes all or part of gutter 150 may be polycarbonate (PC), acrylonitrile butadiene styrene (ABS), or a PC/ABS blend. In other examples, a material that constitutes all or part of gutter 150 may be metal. For example, the material that constitutes all or part of gutter 150 may be aluminum. In one example, the material that constitutes all or part of the housing may be metal (such as aluminum), and the material that constitutes all or part of gutter 150 may be plastics. In one example, the material that constitutes all or part of the housing and gutter 150 may be metal (such as aluminum). In one example, the material that constitutes all or part of the housing and gutter 150 may be plastics.

Gutter 150 may be connectable to base 112 of housing 110. In some examples, gutter 150 may be removably connectable to base 112 of housing 110 by an interference connection or "push" fit. In other examples, the connection between gutter 150 and base 112 may be achieved by a fastener, adhesive or welding. In other examples, gutter 150 may be formed integrally with base 112.

In some examples, gutter 150 may be provided with a surface layer or coating. The surface layer may reduce the friction coefficient of gutter 150. It may be that in some examples, less printing fluid adheres to a gutter 150 provided with a surface layer. In some examples, the surface layer may be composed of a "non-stick" coating. In some examples, the surface layer may be composed of a fluoropolymer, such as polytetrafluoroethylene (PTFE). In some examples, the surface layer may be composed of polyurethane. In some examples, the surface layer may be composed of silicone-modified polyurethane. For example, the surface layer may be composed of polymer which is obtainable from a mixture of polyols, di- or polyisocyanates, and silicone monomers, oligomers or polymers.

In use, printing substance which is not developed to developer roller 120 accumulates in cavity 118. The accumulation of ink in cavity 118 may be low when apparatus 100 is provided with gutter 150. It may be that in some examples, the accumulation of ink in cavity 118 is low even when apparatus 100 is oriented away from the vertical (i.e. when the direction from the base of the developer unit to the developer roller is not vertical).

In some examples, the curved shape of gutter 150 may be parabolic. In other examples, the curved shape of gutter 150 may be hyperbolic. In some examples, some portions of gutter 150 are parabolic, and some portions of gutter 150 are hyperbolic.

In some examples, the curved shape of gutter 150 may remain the same along length 158. In other examples, the curved shape of gutter 150 may vary along length 158. In some examples, where the curved shape of gutter 150 varies along length 158, the gutter 150 may have a profile shaped as a section of a cone.

FIGS. 2A, 2B, 2C and 2D show an apparatus 200 according to an example of the present disclosure, wherein the curved shape of the gutter remains the same along its length.

Figure 2A:
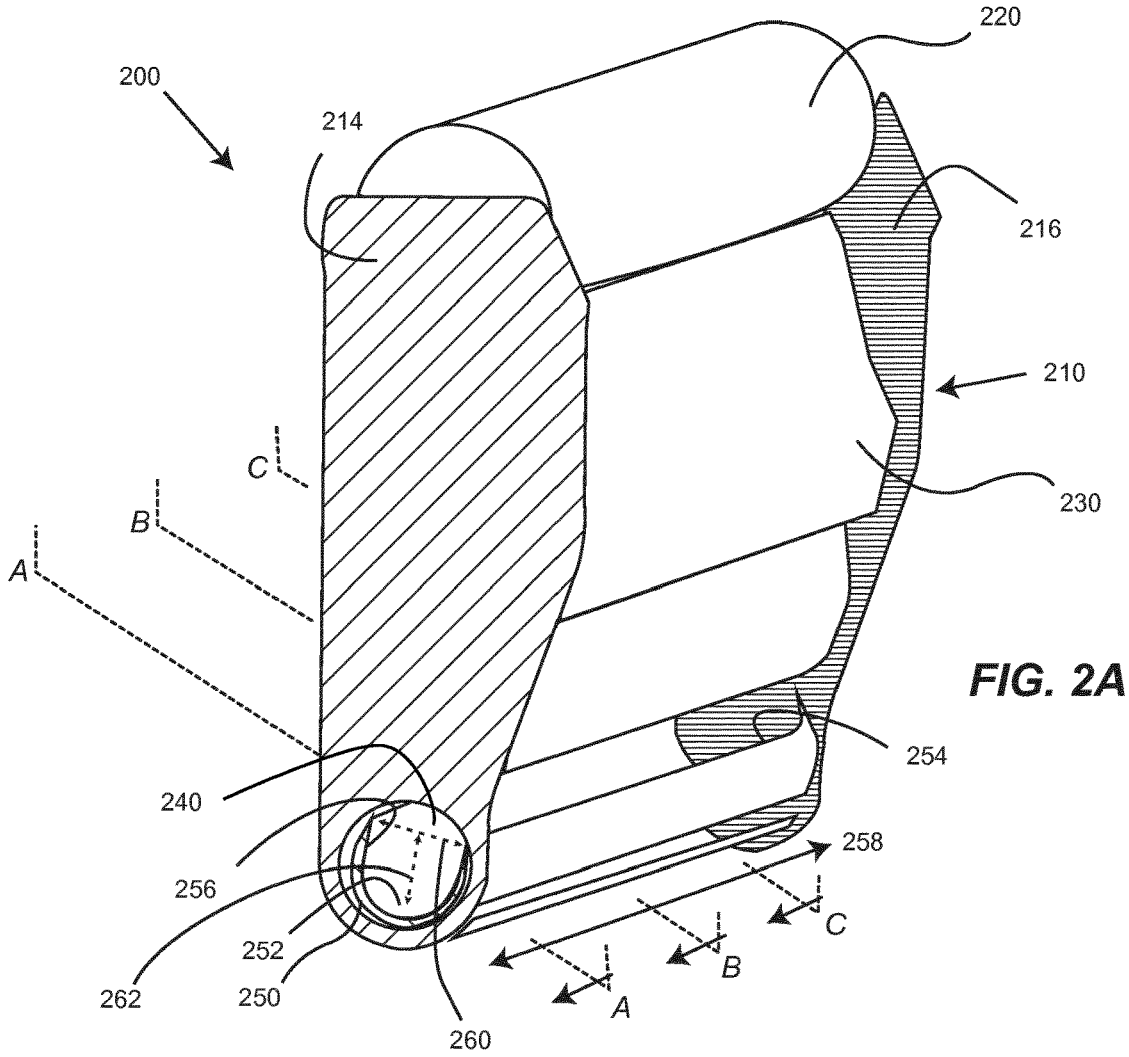
FIG. 2A is a schematic diagram showing a developer unit according to an example of the present disclosure.
Figure 2B:
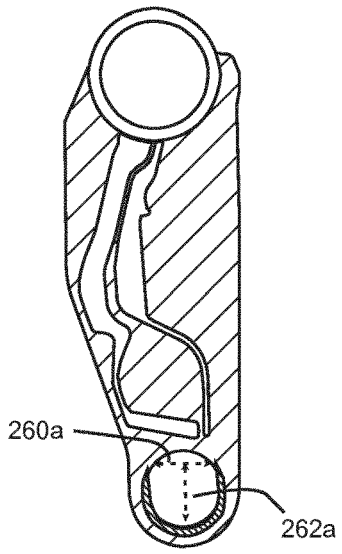
FIGS. 2B-2D are schematic diagrams showing sectional views of the developer unit of FIG. 2A.
Figure 2C:
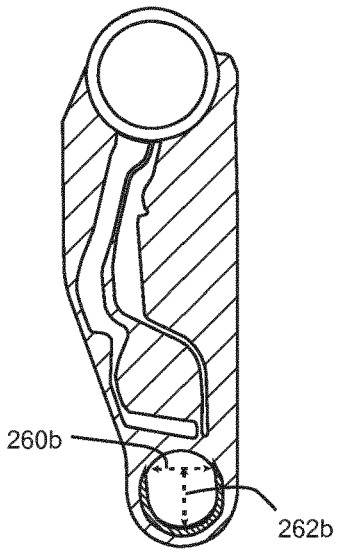
Figure 2D:
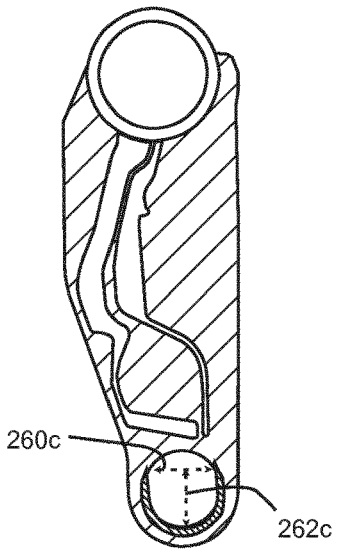

FIG. 2A is a perspective view of apparatus 200. FIGS. 2B, 2C and 2D are transverse sectional views of apparatus 200, viewed in planes A-A, B-B and C-C of FIG. 2A respectively. For brevity, features in FIGS. 2A-D, the functions thereof that are the same as those features already described with reference to FIGS. 1A-C, are given similar reference numerals to those in FIGS. 1A-C but increased by multiples of 100.

Gutter 250 has a width 260 and a depth 262. Width 260 refers to the greatest distance between the side walls 254 and 256 measured in a direction transverse to length 258. Depth 262 refers to the distance from floor 252 to a plane in which the top ends of side walls 254 and 256 lie, measured in a direction normal to floor 252 (unless the distance between the top ends of the wall is less than width 260, in which case depth 262 refers to the distance from floor 252 to the plane in which width 260 lies, measured in a direction normal from floor 252).

Width 260 and depth 262 of gutter 250 are approximately constant along length 258. This is depicted in FIGS. 2B-2D: width 260*a* at plane A-A is equal to width 260*b* at plane B-B and equal to width 260*c* at plane C-C. Similarly, depth 262*a* at plane A-A is equal to depth 262*b* at plane B-B and equal to depth 262*c* at plane C-C FIGS. 3A, 3B, 3C and 3D show an apparatus 300 according to an example of the present disclosure, wherein the curved shape of the gutter varies along its length.

Figure 3A:
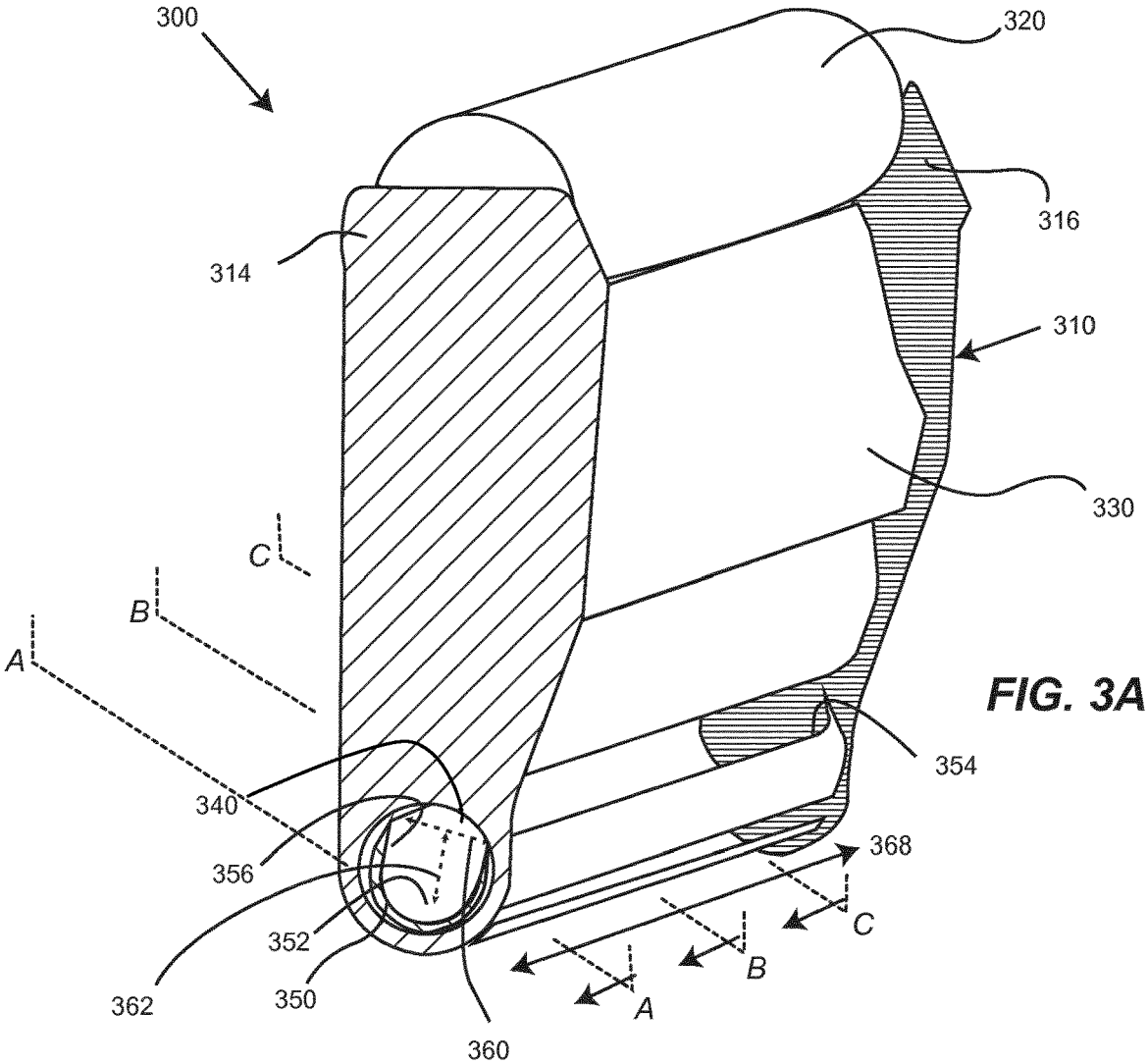
FIG. 3A is a schematic diagram showing a developer unit according to an example of the present disclosure.
Figure 3B:
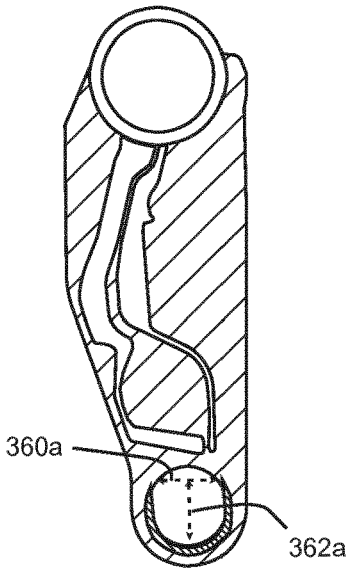
FIGS. 3B-3D are schematic diagrams showing sectional views of the developer unit of FIG. 3A.
Figure 3C:
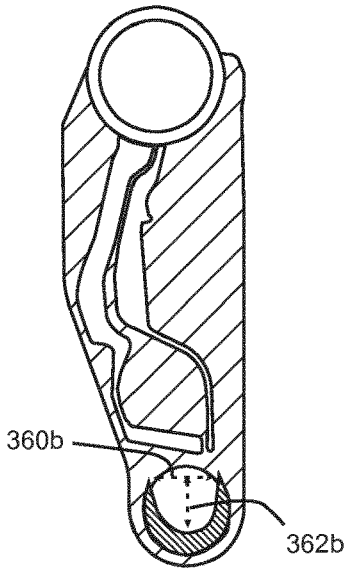
Figure 3D:
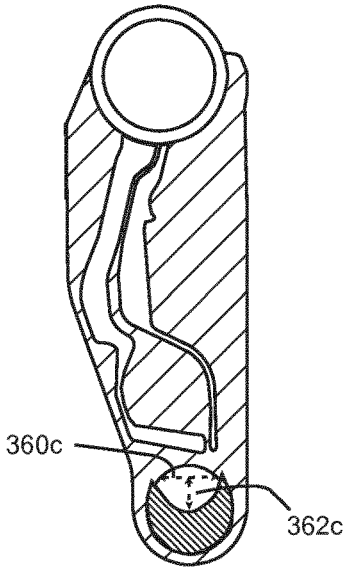

FIG. 3A is a perspective view of apparatus 300. FIGS. 3B, 3C and 3D are transverse sectional views of apparatus 300, viewed in planes A-A, B-B and C-C of FIG. 3A respectively. For brevity, features in FIGS. 3A-D, the functions thereof that are the same as those features already described with reference to FIGS. 2A-D, are given similar reference numerals to those in FIGS. 2A-D but increased by multiples of 100.

Gutter 350 has a width 360 and a depth 362. Width 360 and/or depth 362 may vary along length 358.

In this example, as can be seen in FIGS. 3B-3D, width 360 remains constant along length 358: width 360*a* at plane A-A is equal to width 360*b* at plane B-B and equal to width 360*c* at plane C-C. Depth 362 does not remain constant along length 358: depth 362*a* is greater than depth 362*b*, which in turn is greater than depth 362*c*. In this example, depth 362 of gutter 350 increases towards first wall 314; the depth 362 of gutter 350 is greater near first wall 314 than near second wall 316 (that is, greater near ink outlet 340). In other examples, depth 362 of gutter 350 may decrease towards first wall 314; the depth 362 of gutter 350 may be smaller near first wall 314 than near second wall 316 (that is, smaller near ink outlet 340). In some examples, depth 362 may vary at a constant rate along length 358.

In some examples, width 360 of gutter 350 may increase towards first wall 314; the width 360 of gutter 350 may be greater near first wall 314 than near second wall 316 (that is, greater near ink outlet 340). In other examples, width 360 of gutter 350 may decrease towards first wall 314; the width 360 of gutter 350 may be smaller near first wall 314 than near second wall 316 (that is, smaller near ink outlet 340). In some examples, width 360 may vary at a constant rate along length 358.

In some examples, width 360 of gutter 350 may vary along length 358 as described hereinabove, while depth 362 remains constant. In some examples, depth 362 of gutter 350 may vary along length 358 as described hereinabove, while width 360 remains constant. In some examples, width 360 and depth 362 may vary along length 358 as described hereinabove.

In some examples, the ratio of width 360 to depth 362 may remain constant along length 358. That is not to say that width 360 and depth 362 necessarily remain constant along length 358, but the ratio between them may remain constant. For example, both the width 360 and depth 362 of gutter 350 near the second wall 316 may be smaller than the width 360 and depth 362 near the first wall 314, wherein the ratio of width 360 to depth 362 is the same at all points along the 358.

In other examples, the ratio of width 360 to depth 362 may vary along length 358. In some examples, as depicted in FIGS. 3A to 3D, the ratio of width 360 to depth 362 near second wall 316 may be greater than the ratio of width 360 to depth 362 curve near first wall 314 (that is, a smaller width:depth ratio near ink outlet 340). For example, the width:depth ratio near second wall 316 may be around 3:1, and the width:depth ratio near first wall 314 may be around 1:1. In other examples (not depicted), the ratio of width 360 to depth 362 near second wall 316 may be smaller than the ratio of width 360 to depth 362 curve near first wall 314 (that is, a greater width:depth ratio near ink outlet 340). For example, the width:depth ratio near the second wall may be around 1:1, and the width:depth ratio near the first wall may be around 3:1. In some examples the ratio of width 360 to depth 362 may vary at a constant rate along length 358.

Figure 4:
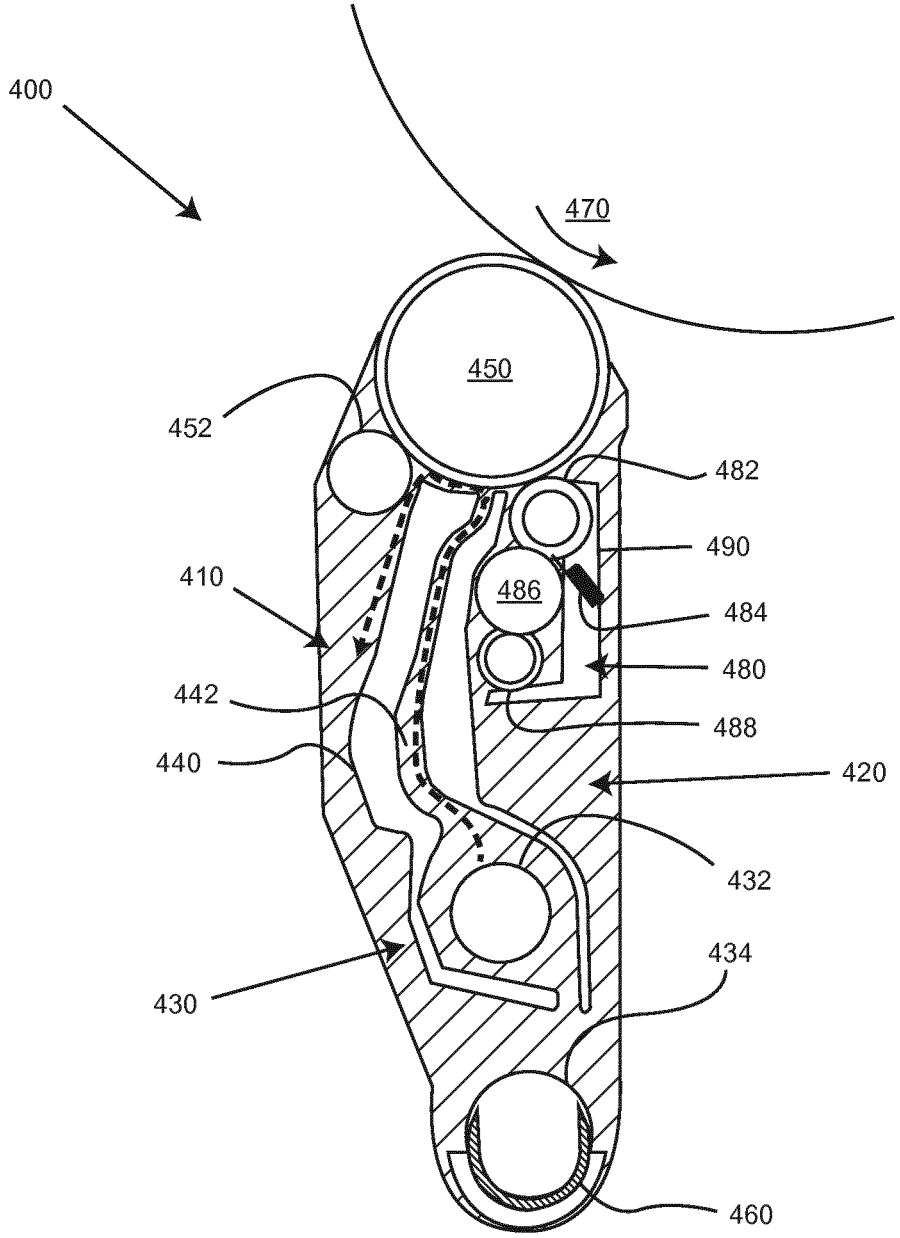
FIG. 4 is a schematic diagram showing a developer unit according to an example of the present disclosure.

FIG. 4 shows an apparatus 400. Numbering of features in FIG. 4 does not necessarily correspond to earlier figures.

The apparatus 400 is an ink developer unit, and may comprise a housing 410 defining a cavity 420, and a developer assembly 430. The developer assembly 430 may comprise, for example, an ink inlet 432, an ink outlet 434, a developer electrode 440, a developer roller 450, and a squeegee roller 452.

In use, the apparatus 400 may receive ink from an ink tank (not pictured) through inlet 432. The ink supplied to the apparatus 400 (also referred to as undeveloped ink) may comprise about 3% non-volatile solids by volume, such as about 3% ink particles by volume. The ink tank may be arranged separately from the apparatus 400 in an electrographic printer, and may be connected to inlet 432 by a conduit (not pictured). The ink supplied to the apparatus may travel through the apparatus 400 as shown by the dashed arrow. Firstly, the ink may pass through channel 442 in the electrode 440, which may cause some of the ink particles to become charged.

The ink may then pass between the electrode 440 and the developer roller 450, wherein some of the charged particles may be developed onto the surface of the developer roller 450. The ink disposed on the surface of the developer roller 450 may then be dispersed into a layer of more uniform thickness by the squeegee roller 452, and then transferred to the photo-imaging cylinder 470. The ink disposed on the surface of the developer roller 450 (also referred to as developed ink) may comprise about 20% non-volatile solids by volume, such as about 20% ink particles by volume.

The apparatus 400 may also comprise a cleaning unit 480, which may include a cleaning roller 482, wiper 484, a sponge roller 486, and a squeezer roller 488. The wiper may be supported by a wiper wall 490 in the cleaning unit 480. The cleaning unit 480 may be arranged such that, in use, residual ink left on the developer roller 450 after ink has been transferred to the photo-imaging cylinder 470 may be transferred to the cleaning roller 482. In turn, the sponge roller 486 may remove ink from the surface of the cleaning roller 482, and then the squeezer roller 488 may remove ink from the sponge roller 486. Wiper 484 may also be used to ensure that portions of the surface of the cleaning roller 482 are substantially free of ink before contacting the developer roller 450 again.

Ink which is not transferred to the developer roller 450 may accumulate in the cavity 420, and may flow from the apparatus 400 along gutter 460 and out through ink outlet 434. Ink may exit the apparatus 400 through ink outlet 434 and return to the ink tank (not pictured). Gutter 460 may correspond to any gutter described hereinabove.

According to another aspect of the present disclosure there is provided an electrographic printer system. The printer comprises a photo-imaging cylinder, which has a curved surface. The printer also comprises at least two ink developer units. Each ink developer unit corresponds to any of the developer units described hereinabove. The ink developer units are arranged around the curved surface of the photo-imaging cylinder. Apparatus comprising a gutter as defined herein may accumulate low levels of ink in the ink developer unit cavity, even when the ink developer units are arranged radially around a photo-imaging cylinder. For example, one or more of the developer units may be arranged in a vertical orientation in the printer system (that is, the direction from the base of the developer unit to the developer roller is vertical). The gutter in the developer unit may direct ink to the ink outlet of the developer unit in this orientation. In some examples, one or more of the developer units may be arranged in a non-vertical orientation in the printer system (that is, the direction from the base of the developer unit to the developer roller is not vertical). The gutter in the developer unit may direct ink to the ink outlet of the developer unit in this orientation as well. In some examples, one or more of the developer units may be arranged in an orientation which is approximately normal to the surface of the photo-imaging cylinder (that is, the direction from the base of the developer unit to the developer roller is perpendicular to the tangent of the curve of the photo-imaging cylinder at the point closest to the developer unit). The gutter in the developer unit may direct ink to the ink outlet of the developer unit in this orientation as well.

Figure 5:
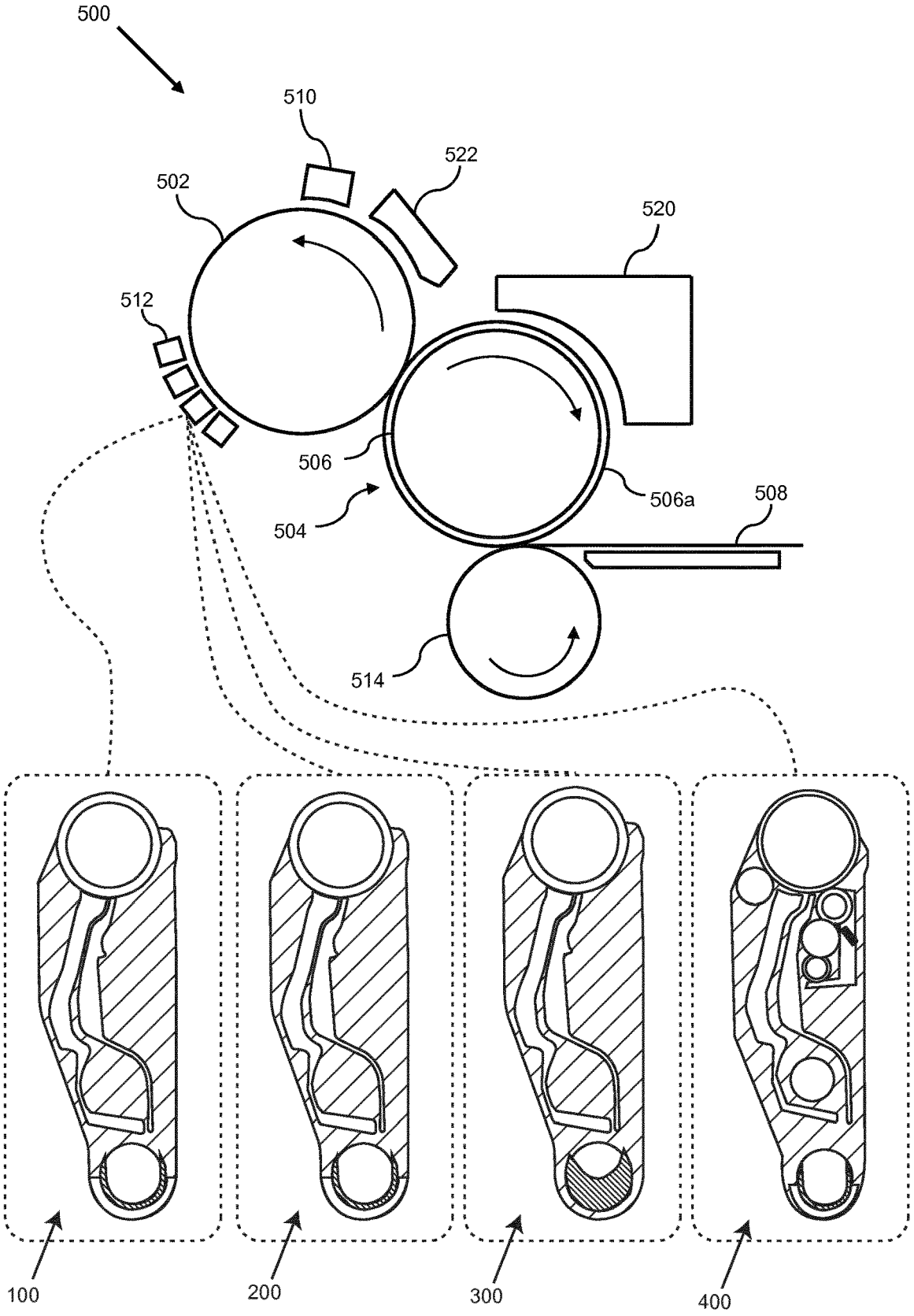
FIG. 5 is a schematic diagram showing an electrographic printer system in accordance with an example of the present disclosure.

FIG. 5 shows an electrographic printer 500 according to an example of the present aspect of the disclosure. A desired image may be initially formed on a photoconductor using a printing substance, such as liquid ink. In the example shown, the photoconductor is a photo-imaging cylinder 502. The printing substance, in the form of the image, may then be transferred from the photo-imaging cylinder 502 to an intermediate surface, such as the surface of a transfer element 504. The photo-imaging cylinder 502 may continue to rotate, passing through various stations to form the next image.

In the example depicted in FIG. 5, the transfer element 504 can comprise a transfer cylinder 506 and a transfer blanket 506*a* surrounding the transfer cylinder 506, and the surface of the transfer element 504 can be a surface of the transfer blanket 506*a*. The transfer element may otherwise be referred to as a transfer member 504. In other examples, transfer member 504 may comprise a continuous belt supporting a transfer blanket, or a continuous transfer blanket belt (wherein the transfer blanket is not disposed on a supporting member).

According to one example, an image may be formed on the photo-imaging cylinder 502 by rotating a clean, bare segment of the photo-imaging cylinder 502 under a photo charging unit 510. The photo charging unit 510 may include a charging device, such as corona wire, charge roller, or other charging device, and a laser imaging portion. A uniform static charge may be deposited on the photo-imaging cylinder 502 by the photo charging unit 510. As the photo-imaging cylinder 502 continues to rotate, the photo-imaging cylinder 502 can pass the laser imaging portion of the photo charging unit 510, which may dissipate localized charge in selected portions of the photo-imaging cylinder 502, to leave an invisible electrostatic charge pattern that corresponds to the image to be printed. In some examples, the photo charging unit 510 can apply a negative charge to the surface of the photo-imaging cylinder 502. In other examples, the charge may be a positive charge. The laser imaging portion of the photo charging unit 510 may then locally discharge portions of the photo imaging cylinder 502, resulting in local neutralized regions on the photo-imaging cylinder 502.

In this example, a printing substance may be transferred onto the photo-imaging cylinder 502 by a plurality of printing substance application assemblies, also referred to as developer units 512. Developer units 512 may include any of the developer units described hereinabove, such as apparatus 100, 200, 300, 400 as shown in FIG. 5. In some examples, the printing substance may be liquid ink. In other examples the printing substance may be other than liquid ink, such as toner. In this example, there may be one developer unit 512 for each printing substance color. During printing, the appropriate developer unit 512 can be engaged with the photo-imaging cylinder 502. The engaged developer unit 512 may present a uniform film of printing substance to the photo-imaging cylinder 502.

In this example, following the provision of the printing substance on the photo-imaging cylinder 502, the photo-imaging cylinder 502 may continue to rotate and transfer the printing substance, in the form of the image, to the transfer member 104. In some examples, the transfer member 504 can be electrically charged to facilitate transfer of the image to the transfer member 504.

Once the photo-imaging cylinder 502 has transferred the printing substance to the transfer member 504, the photo-imaging cylinder 502 may rotate past a cleaning station 522 which can remove any residual printing substance and cool the photo-imaging cylinder 502 from heat transferred during contact with the hot blanket. At this point, in some examples, the photo-imaging cylinder 502 may have made a complete rotation and can be recharged ready for the next image.

In some examples, the transfer member 504 may be disposed to transfer the image directly from the transfer member 504 to the substrate 508. In some examples, where the electrographic printer is a liquid electrographic printer, the transfer member 504 may comprise a transfer blanket 506*a* to transfer the image directly from the transfer blanket to the substrate 508. In other examples, a transfer component may be provided between the transfer member 504 and the substrate 508, so that the transfer member 504 can transfer the image from the transfer member 504 towards the substrate 508, via the transfer component.

In this example, the transfer member 504 may transfer the image from the transfer member 504 to a substrate 508 located between the transfer member 504 and an impression cylinder 514. This process may be repeated, if more than one colored printing substance layer is to be included in a final image to be provided on the substrate 508.

Figure 6:
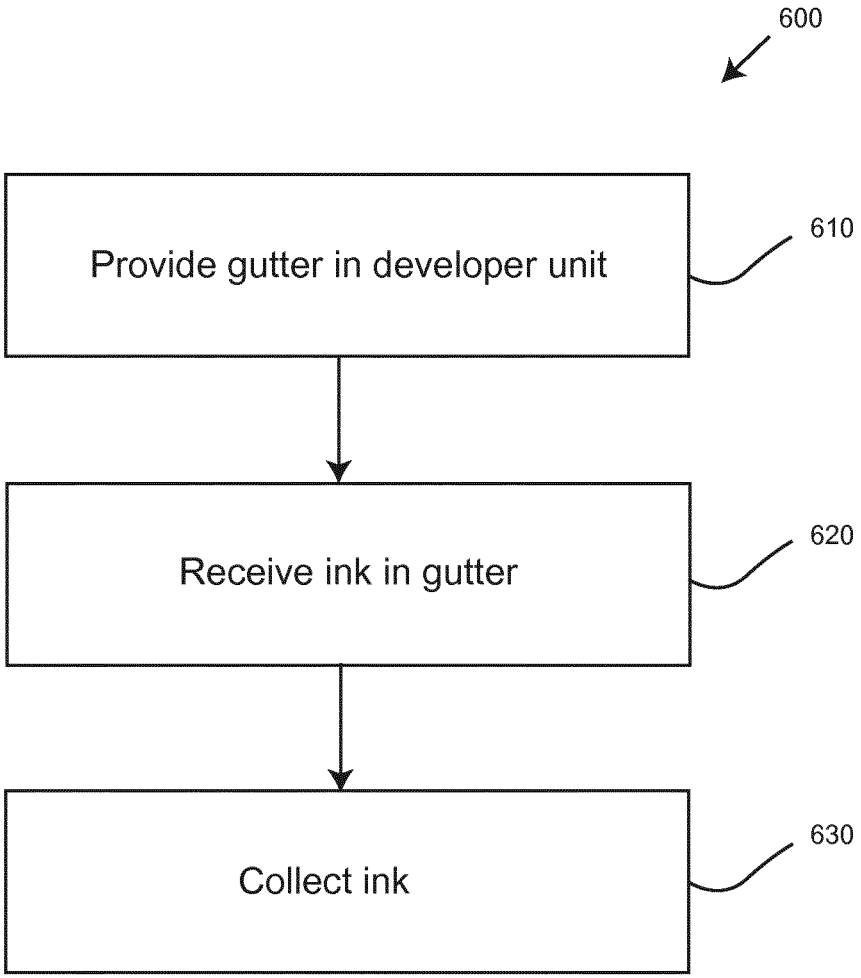
FIG. 6 is a flowchart showing a method of recovering liquid printing substance in accordance with an example of the present disclosure.

According to another aspect of the present disclosure, there is provided a method of recovering ink from an ink developer unit. FIG. 6 shows a method of recovering ink according to an example. Method 600 includes block 610, which comprises providing a gutter at a base of a housing of a developer unit. The provided gutter slopes towards an ink outlet of the developer unit and has a surface curved transverse to its length. Block 610 may comprise providing a gutter in a developer unit wherein the gutter corresponds to any of those described hereinabove.

Method 600 further includes block 620, which comprises receiving ink in the gutter. Ink may be received in the gutter from an ink tank, which may be arranged separately in a printing system. The ink may pass from the ink tank through an ink inlet in the developer unit, and through a developer assembly in the developer unit to reach the gutter.

Method 600 further includes block 630, which comprises collecting ink from an ink outlet in the developer unit. The ink outlet may be connected to the ink tank by a conduit. The ink may be collected in the ink tank. In an example, the ink is supplied to the gutter from an ink tank, and the ink is subsequently collected in the ink tank.

The preceding description has been presented to illustrate and describe examples of the principles described. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

What is claimed is:

1. An apparatus for use in an electrographic printer, the apparatus comprising:

a housing having a base, a first wall, and a second wall, the housing defining a cavity;

a developer roller rotatable about an axis, the axis extending from the second wall to the first wall;

an ink developer electrode for developing ink to the developer roller, the electrode being arranged in the cavity;

an ink outlet, the ink outlet being arranged in the first wall; and a gutter for directing ink in the cavity towards the ink outlet, the gutter being disposed between the first wall and second wall, and between the developer roller and base the gutter having a floor, a first side, and a second side, each extending along a length of the gutter in a direction from the second wall to the first wall, wherein the floor of the gutter slopes towards the ink outlet to direct ink towards the ink outlet, and wherein the floor and sides of the gutter form a curve transverse to the length of the gutter to direct ink towards the floor, the curve having a width and depth.

2. The apparatus of claim 1, wherein a ratio of width to depth of the curve is approximately constant along the length of the gutter.

3. The apparatus of claim 1, wherein a ratio of width to depth of the curve varies along the length of the gutter.

4. The apparatus of claim 3, wherein the ratio of width to depth of the curve near the second wall is greater than the ratio of width to depth of the curve near the first wall.

5. The apparatus of claim 1, wherein the width of the curve is approximately constant along the length of the gutter.

6. The apparatus of claim 1, wherein the slope of the floor is an angle of from 1 to 3° from the base of the apparatus.

7. The apparatus of claim 1, wherein the gutter includes a surface layer.

8. The apparatus of claim 1, wherein the gutter is integrally formed with the base of the apparatus.

9. The apparatus of claim 1, wherein the gutter is releasably connected to the base of the apparatus.

10. The apparatus of claim 1, wherein a material that constitutes all or part of the gutter is plastics.

11. The apparatus of claim 1, wherein the gutter abuts the first wall of the apparatus.

12. An electrographic printer comprising:

a photo-imaging cylinder, the photo-imaging cylinder having a curved surface; and at least two ink developer units, each ink developer unit comprising:

a housing having a base, a first wall, and a second wall, the housing defining a cavity;

a developer roller rotatable about an axis, the axis extending from the second wall to the first wall;

an ink developer electrode for developing ink to the developer roller, the electrode being arranged in the cavity;

an ink outlet, the ink outlet being arranged in the first wall; and a gutter for directing ink in the cavity towards the ink outlet, the gutter being disposed between the first wall and second wall, and between the developer roller and base the gutter having a floor, a first side, and a second side, each extending along a length of the gutter in a direction from the second wall to the first wall, wherein the floor of the gutter slopes towards the ink outlet to direct ink towards the ink outlet, and wherein the floor and sides of the gutter form a curve transverse to the length of the gutter to direct ink towards the floor, the curve having a width and depth;

the ink developer units being arranged around the curved surface of the photo-imaging cylinder.

13. The electrographic printer of claim 12, wherein each ink developer unit is configured to supply a different colored ink to the photo-imaging cylinder.

14. A method of recovering ink from a developer unit, method comprising:

providing a gutter at a base of a housing of the developer unit, wherein the housing has a first wall, and a second wall, the housing defining a cavity;

wherein the gutter is for directing ink in the cavity towards the ink outlet, the gutter being disposed between the first wall and second wall, and between a developer roller and the base;

wherein the gutter has a floor, a first side, and a second side, each extending along a length of the gutter in a direction from the second wall to the first wall;

wherein the floor of the gutter slopes towards the ink outlet to direct ink towards the ink outlet;

wherein the floor and sides of the gutter form a curve transverse to the length of the gutter to direct ink towards the floor, the curve having a width and depth;

receiving ink in the gutter, thereby directing ink to the ink outlet; and collecting ink from the ink outlet.

15. The method of claim 14, wherein ink is supplied to the gutter from an ink tank, and the ink is subsequently collected in the ink tank.

* * * * *